US006016851A

United States Patent [19]

Preuner

[11] Patent Number: 6,016,851

[45] Date of Patent: Jan. 25, 2000

[54] METHOD AND APPARATUS FOR PROVIDING THE WARP THREAD END OF A FABRIC RIBBON

[75] Inventor: Christian Preuner, Frankenburg, Austria

[73] Assignee: WIS Seaming Equipment, Inc., Sandpoint, Id.

[21] Appl. No.: 09/173,953

[22] Filed: Oct. 16, 1998

[51] Int. Cl.[7] ..... D03D 41/00; D21F 1/12

[52] U.S. Cl. ..... 139/383 AA; 28/141

[58] Field of Search ..... 139/383 AA; 28/141; 162/904

[56] References Cited

U.S. PATENT DOCUMENTS

| | | | |
|---|---|---|---|
| 4,985,970 | 1/1991 | Krenkel et al. | 139/383 AA |
| 5,027,483 | 7/1991 | Anderson | 139/383 AA |
| 5,212,858 | 5/1993 | Anderson . | |
| 5,390,708 | 2/1995 | Kuster et al. | 139/383 AA |
| 5,720,323 | 2/1998 | Tremer | 139/383 AA |
| 5,738,151 | 4/1998 | Lee | 139/383 AA |

*Primary Examiner*—Andy Falik

*Attorney, Agent, or Firm*—Wells, St. John, Roberts, Gregory & Matkin, P.S.

[57] ABSTRACT

A method and apparatus for providing warp thread ends as auxiliary weft in a seam weaving device is disclosed and where the warp thread ends are connected to an adhesive seam and a weft thread bundle is formed in the warp thread ends. An auxiliary shed is then formed in the weft thread bundle for successively releasing the warp thread ends from the weft thread bundle. After being released from the weft thread bundle, each successive warp thread end is separated from the warp thread ends which are retained by the weft thread bundle and then cut from the adhesive seam. This allows the warp thread end to then be withdrawn from the auxiliary shed to be provided as an auxiliary weft in a seam.

12 Claims, 3 Drawing Sheets

4
5
14
15
9
3
10
17
18
14
10
17
18
8d
3c
14
12
10
8c
3a
14c
12
6
10
8a
3b
14a
12
10
8b
18
14b
17
18
20
12
8
3
2
1
7
16
19

METHOD AND APPARATUS FOR PROVIDING THE WARP THREAD END OF A FABRIC RIBBON

CROSS-REFERENCE TO RELATED APPLICATIONS

The application claims priority under 35 USC § 119 to foreign patent application Serial No. A1763/97, filed on Oct. 17, 1997 in Austria.

FIELD OF THE INVENTION

This invention relates to a method of providing the warp thread ends of a fabric ribbon from which the weft threads are withdrawn in the vicinity of the warp thread ends with the exception of a weft thread bundle extending at a distance from the remaining edge of the fabric, before the warp thread ends are isolated one after the other corresponding to the weaving order by a change of shed of an auxiliary shed formed by means of the weft threads of the remaining weft thread bundle, and are withdrawn from the auxiliary shed on the side of the edge of the fabric.

DESCRIPTION OF THE PRIOR ART

For connecting the two ends of a length of fabric, for instance for producing dehydration or drying screens for the paper industry, the ends of the warp threads extending in longitudinal direction of the fabric ribbon, which protrude beyond the edge of the fabric, are used as auxiliary weft threads and woven into auxiliary warp threads from both sides, which auxiliary warp threads are provided in the direction of the weft threads of the fabric ribbon between the two fabric edges to be joined. Weaving in the auxiliary weft threads is effected by means of a shedding means for the auxiliary warp threads, which is activated corresponding to the weaving order. To ensure that the warp thread ends protruding beyond the fabric edge can be seized by grippers and are drawn through the respective shed formed by the auxiliary warp threads, the warp thread ends must be isolated one after the other corresponding to the weaving order. For this purpose it is known (U.S. Pat. No. 5,212,858 A) to hold the warp thread ends in a magazining collar formed by a bundle of weft threads, so that by forming an auxiliary shed with these weft threads of the magazining collar, the individual warp thread ends can be released one after the other corresponding to the weaving order and can be separated from the warp thread ends still held in the magazining collar. The separating means consists of a blow nozzle, whose blast air stream seizes the respectively isolated warp thread ends and supplies the same to a take-over gripper, which pneumatically retains the isolated warp thread end and withdraws the same from the auxiliary shed formed by the weft threads of the magazining collar, so as to transfer the warp thread end thus provided to a pull-through gripper for weaving it into the auxiliary warp threads of the seam to be formed between the fabric edges. Providing the warp thread ends for the seam to be formed between the fabric edges as described above chiefly involves the disadvantage that the magazining collar must be produced manually, so as to again obtain a fabric strip comprising two to three repeats, namely at a distance from the respective fabric edge which depends on the seam width between the fabric edges to be joined.

SUMMARY OF THE INVENTION

It is therefore the object underlying the invention to develop a method as described above such that the expensive manual work for producing the magazining collar can be omitted.

This object is solved by the invention in that first of all the end portions of the warp thread ends liberated from the weft threads and aligned at least approximately parallel to each other are connected with each other by an adhesive seam, and that then the warp thread ends isolated one after the other corresponding to the weaving order are mechanically separated from the warp thread ends still held in the weaving order by the weft threads of the weft thread bundle and are held at a distance from each other, before the respectively isolated warp thread ends are cut off from the adhesive seam and are withdrawn from the auxiliary shed.

By connecting the end portions of the warp thread ends by means of an adhesive seam, the warp thread ends cannot be held in the weaving order of the fabric ribbon corresponding to a magazining collar, but at least be aligned to such an extent that isolating them by forming a shed can be effected with few weft threads merely required for maintaining the weaving order. Therefore, the weft threads provided for forming an auxiliary shed merely have the function of mechanically separating the warp thread end released with each change of shed from the warp thread end succeeding in weaving order, without entraining the succeeding warp thread end, which is easily possible in particular in the vicinity of each weft thread, which before the change of shed for releasing the warp thread end to be isolated holds this warp thread end in the weaving order, because after the change of shed this weft thread retains the succeeding warp thread end in the weaving order. The weft threads in the vicinity of the warp thread ends therefore have the function to secure the weaving order, but not to hold the warp thread ends in a certain alignment, so that no fabric strip must be formed with these weft threads. It is rather sufficient to withdraw these few weft threads from the edge of the fabric and arrange them one beside the other with a lateral distance from each other and from the edge of the fabric, which involves no particular effort, because no fabric must be formed. For discharging the warp thread ends isolated one after the other from the auxiliary shed formed by the weft thread bundle, the respectively isolated warp thread ends must be cut off from the adhesive seam and be withdrawn from the auxiliary shed. Since after the mechanical separation the isolated warp thread ends are held at a distance from each other by the warp thread ends still held in the weaving order, cutting off the respectively isolated warp thread end involves no difficulties.

For easily isolating the warp thread ends of a fabric ribbon connected with each other by an adhesive seam in the vicinity of their end portions, an apparatus is required which consists of a shedding means for a weft thread bundle extending at a lateral distance from the edge of the fabric and retaining the warp thread ends in the weaving order, of a separating means for isolating the warp thread ends released one after the other by a change of shed of the shedding means corresponding to the weaving order, and of a take-over gripper for the warp thread ends isolated by means of the separating means. The separating means may advantageously have thread pickers disposed between the weft threads and adjustable in direction of the weft threads as well as separating wedges, which like the thread pickers can be activated individually and be driven between the warp thread ends released by the shedding means and the warp thread ends still held in the weaving order by the weft threads, where on the side of the end portions of the warp thread ends connected with each other a cutting means for the isolated warp thread ends is associated to the separating means.

By means of the thread pickers adjustable in the direction of the weft threads, the warp thread end released by the auxiliary shed can be separated from the warp thread ends still held in the weaving order, where due to the fact that both the thread pickers and the separating wedges can be activated individually it is possible to first of all withdraw the released warp thread end in the vicinity of each weft thread, which during the preceding change of shed has released the warp thread end to be isolated and at the same time blocks the succeeding warp thread end, from the warp thread ends still remaining in the weaving order. At the same time, the warp thread end at least partially separated from the warp thread ends remaining in the weaving order is held at a distance in this area by means of a separating wedge, which can be driven between the isolated warp thread end and the remaining warp thread ends. The gap between the isolated warp thread end and the remaining warp thread ends, which is due to a separating wedge, provides for driving the separating wedges associated to the adjacent weft threads into this gap, which proceeding from the weft thread releasing the respective warp thread end gradually widens towards the two sides of the auxiliary shed due to the separated wedges driven into the same one after the other, so that the isolated warp thread end held at a distance from the remaining warp thread ends by the separating wedges is cut off from the adhesive seam on the side thereof, and on the other side of the auxiliary shed can be withdrawn from the auxiliary shed by means of a usual gripper and be transferred to a weaving means, which is provided for producing a connecting seam between the fabric edges by means of the warp thread ends woven into an auxiliary warp from both sides and used as auxiliary weft threads.

The shedding means for producing the auxiliary shed provided for isolating the warp thread ends can accommodate the weft threads in eyelets in a conventional way. Particularly simple constructional conditions are obtained, however, when the shedding means has guiding tubes for the weft threads parallel to each other, so that unimpeded by the weft threads the isolated warp thread end can be withdrawn from the remaining warp thread ends between the guiding tubes, namely with small regulating distances for the guiding tubes.

Although the thread pickers for the warp thread ends to be isolated may be designed differently, particularly simple constructional conditions are obtained when the thread pickers consist of brush bristles protruding against the warp thread ends, which are provided at carriers adjustable in longitudinal direction of the weft thread. By means of these brush bristles the warp thread ends released one after the other are moved away from the warp thread ends held in the weaving order, where due to the possible use of the brushes merely in the vicinity of a weft thread retaining the succeeding warp thread end in the weaving order, and due to the subsequent separation of the isolated warp thread by means of the separating wedges to be driven one after the other into the widening gap, an undesired entrainment of a warp thread end still held in the weaving order is simply excluded.

In order to ensure a corresponding spatial allocation of the warp thread ends held in the weaving order to the separating means, guide pieces extending transverse to the warp thread ends may be provided for the warp thread ends held in the weaving order, which guide pieces are guiding between each other the warp thread ends held in the weaving order directly before the separating means.

BRIEF DESCRIPTION OF THE DRAWING

The method in accordance with the invention will now be explained in detail with reference to the drawing, wherein.

DESCRIPTION OF THE PREFERRED EMBODIMENT

Figure 1:
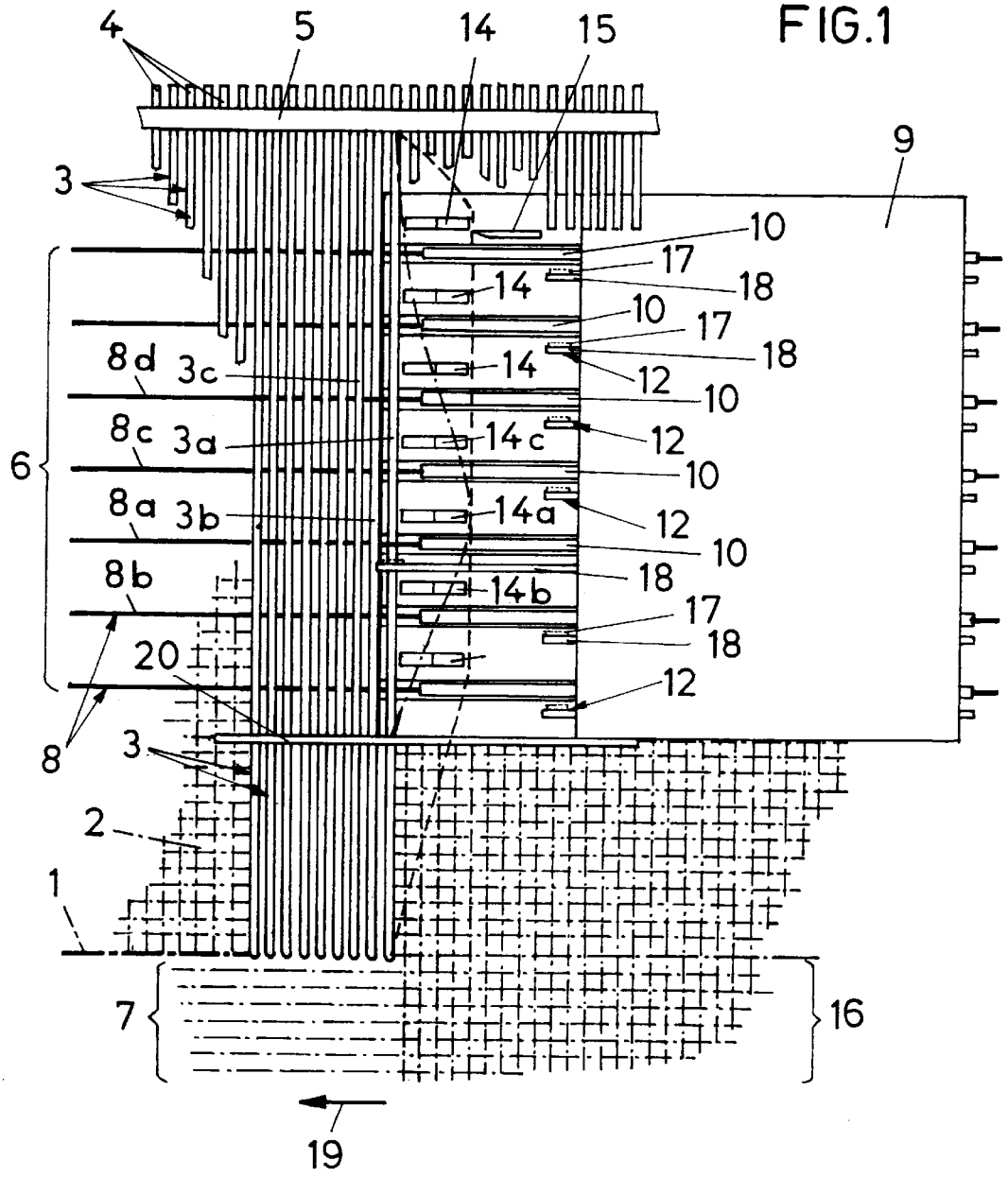
FIG. 1 represents an inventive apparatus for providing the warp thread ends of a fabric ribbon in a schematic top view.

To ensure that by means of the illustrated apparatus ends 3 of the warp threads extending in longitudinal direction of a fabric ribbon 2, which ends protrude beyond the fabric edge 1 of the fabric ribbon 2, can be isolated one after the other corresponding to the weaving order, the weft threads must first of all be withdrawn in the vicinity of the end portions 4 of the warp thread ends 3, and the end portions 4 liberated from the weft threads must be connected with each other by an adhesive seam 5, before the weft threads remaining between the adhesive seam 5 and the fabric edge 1 are withdrawn with the exception of a weft thread bundle 6. Upon isolating the warp thread ends 3, a connecting seam can then be made by means of the warp thread ends 3 protruding beyond the fabric edge 1, in order to produce an endless fabric ribbon 2. Between the opposing fabric edges 1 of a fabric ribbon 2 an auxiliary warp 7 is therefore provided, into which the warp thread ends 3 protruding beyond the fabric edge 1 are woven as auxiliary weft threads, namely in a conventional way by means of a shedding of the auxiliary warp 7. Although before connecting the end portions 4 of the warp thread ends 3 by means of the adhesive seam 5, the same must be aligned accurately enough by means of a brush or a comb, in order to hold the warp thread ends 3 in a predetermined alignment, this bond is not enough to release the individual warp thread ends one after the other corresponding to the weaving order. Therefore, a weft thread bundle 6 should be prepared, whose weft threads 8 are withdrawn from the fabric edge 1 and are arranged at a lateral distance from each other and from the fabric edge 1. The number of these weft threads 8 can be restricted to the number required for maintaining the weaving order. As can be taken from the schematic illustration shown in FIG. 1, this embodiment comprises a fabric woven with seven shafts, so that seven weft threads 8 are sufficient for securing the weaving order.

Figure 2:
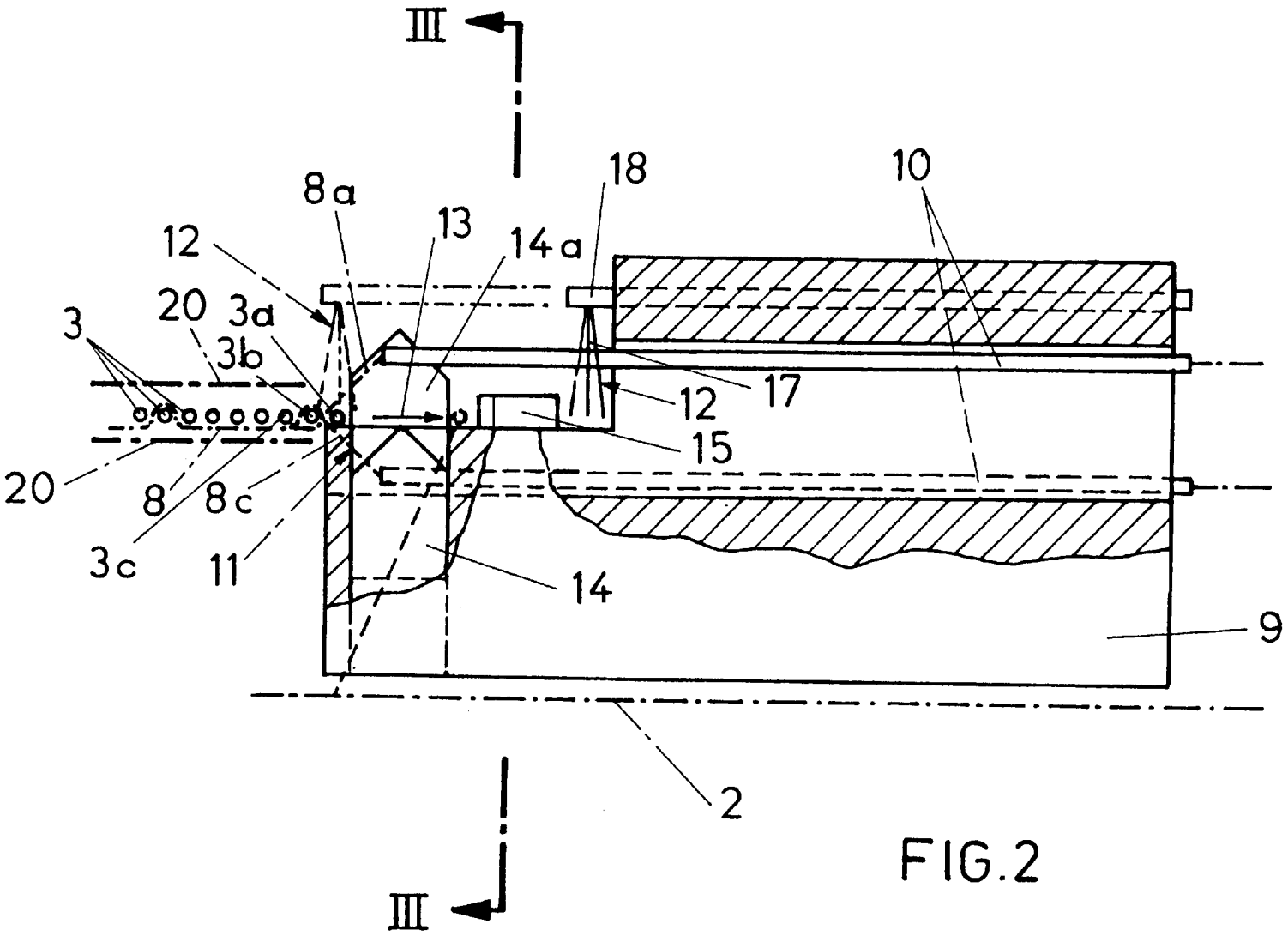
FIG. 2 represents this apparatus in a partly cut-away side view on an enlarged scale.
Figure 3:
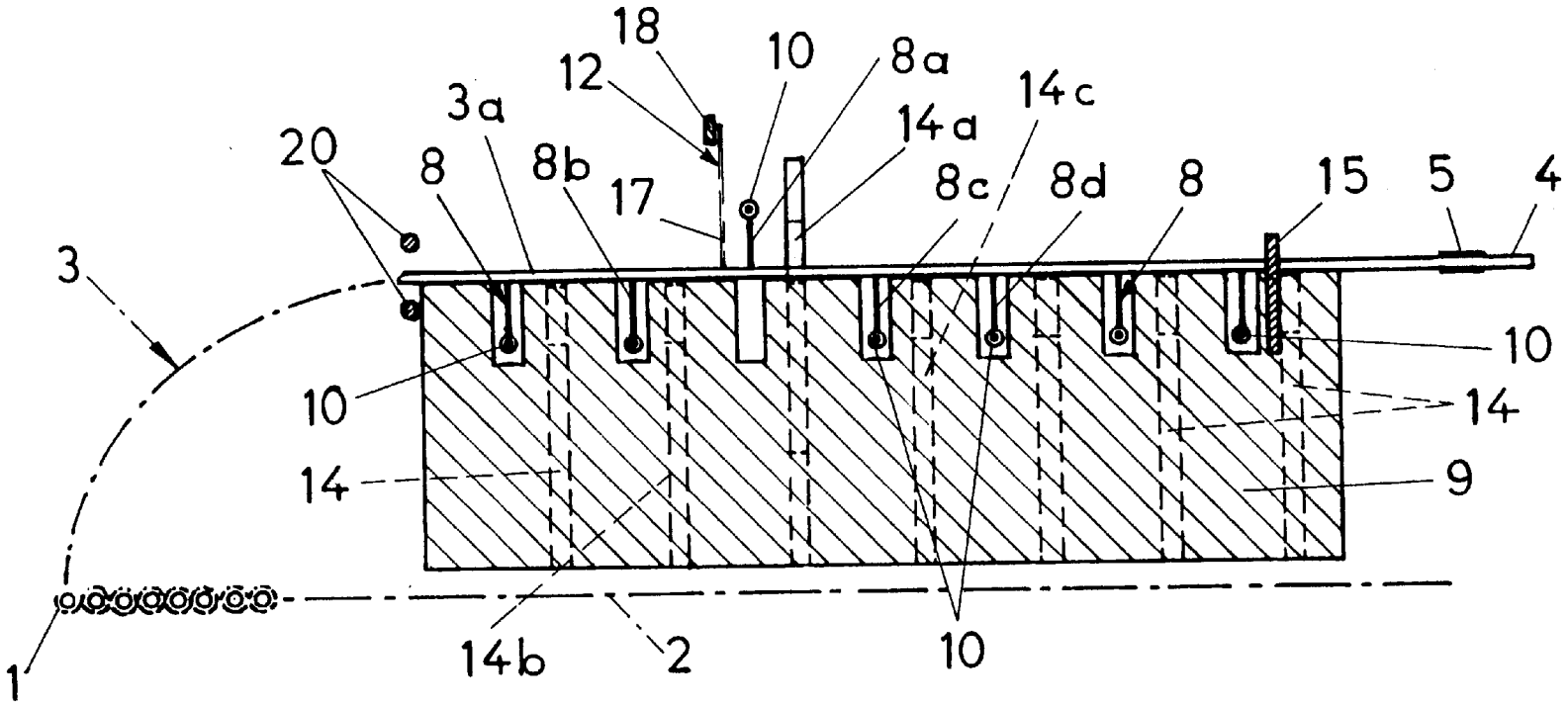
FIG. 3 represents a section along line III—III of FIG. 2.

The weft threads 8 of the fabric ribbon 2 prepared as described above are drawn into a shedding means 9, which for shedding purposes comprises guiding tubes 10 correspondingly movable up and down. The auxiliary shed 11 formed by the shedding means 9 provides for releasing the warp thread ends 3 corresponding to the weaving order. The auxiliary shed 11 represented in FIG. 2 releases the warp thread end 3*a* foremost in accordance with the weaving order, but not the warp thread end 3*b* succeeding in weaving order, so that the foremost warp thread end 3*a* can be separated from the warp thread ends 3 retained by the weft threads 8. This separation is first of all effected by means of a thread picker 12 in the vicinity of that weft thread 8*a* which corresponding to the weaving order prevents the succeeding warp thread end 3*a* between the adjacent weft threads 8*b* and 8*c* from being entrained. The warp thread end 3*a* can therefore be withdrawn from the warp thread end 3*b* in the direction of the arrow 13 by means of the thread picker 12 adjustable in longitudinal direction of the weft threads 8 and associated to the guiding tube 10 for the weft thread 8*a,* in order to continue this separation process by means of a separating wedge 14 likewise associated to the guiding tube 10 for the weft thread 8*a,* which separating wedge is driven between the warp thread ends 3*a* and 3*b*. The course of the warp thread end 3*a* obtained by driving in the separating wedge 14 is illustrated in dash-dotted lines in FIG. 1. From this representation it can be taken that by means of the separating wedges 14*b* and 14*c* associated to the adjacent weft threads 8*b* and 8*c*, the distance of the warp thread end 3*a* from the warp thread end 3*b* succeeding in weaving order is gradually increased towards the two sides of the auxiliary shed 11, until the course in accordance with the broken line has been achieved, which is predetermined in the case of an engagement of all separating wedges 14. In this position of the warp thread end 3*a*, the end portion 4 of the warp thread end 3*a* can be cut off by means of a cutting means 15 in the vicinity of the outermost separating wedge 14, in order to seize the warp thread end 3*a* on the opposite side of the auxiliary shed 11 by means of a known transfer gripper and withdraw the same from the auxiliary shed 11. After the transfer of the warp thread end 3*a* withdrawn from the auxiliary shed 11 to a pull-through gripper for the shed formed by the auxiliary warp 7, the warp thread end 3*a* can be woven into the auxiliary warp 7 for forming the connecting seam.

For providing the warp thread end 3*b* succeeding in weaving order as auxiliary weft thread for the merely schematically illustrated connecting seam 16, a change of shed must be effected by means of the shedding means 9 in the vicinity of the guiding tubes 10 for the weft threads 8*a* and 8*d*. By means of the thread picker 12 associated to the guiding tube 10 for the weft thread 8*d*, the warp thread end 3*b* can then be separated from the warp thread end 3*c* succeeding in weaving order and be spaced by means of the separating wedges 14, in order to again weave it into the auxiliary warp 7 after cutting off the warp thread end 3*b* from the end portion 4 held by the adhesive seam 5, namely after a corresponding change of shed. The thread picker 12 in the vicinity of the weft thread 8*d*—like the remaining thread pickers 12—may advantageously consist of brush bristles 17, which are provided on a carrier 18 adjustable in longitudinal direction of the weft threads 8. As the connecting seam 16 proceeds in the direction of the arrow 19, the shedding means 9 must of course be moved on along with the separating means.

To ensure an additional guidance for the warp thread ends 3 in particular in the vicinity of a transfer gripper, guide pieces 20 extending transverse to the warp thread ends 3 may be associated to the separating means, which guide pieces accommodate between each other on the side of the fabric ribbon 1 the warp thread ends 3 held in the weaving order.

I claim:

1. A method of providing warp thread ends as auxiliary weft in a seam weaving device, and wherein the warp thread ends extend from a fabric edge of a length of woven fabric which is formed of the warp threads woven with transverse weft threads, the method comprising:

connecting the warp thread ends to an adhesive seam;

forming a weft thread bundle between the fabric edge and the adhesive seam using existing weft threads from the fabric edge;

forming an auxiliary shed in the weft thread bundle;

manipulating the auxiliary shed so as to successively release a warp thread end from the weft thread bundle;

separating the released warp thread end from adjacent warp thread ends retained by the weft thread bundle;

cutting the released and separated warp thread end from the adhesive seam; and withdrawing the released, separated and cut warp thread end from the auxiliary shed.

2. A method as claimed in claim 1, and further comprising aligning the warp thread ends so as to be substantially parallel, one to another, prior to connecting same to the adhesive seam.

3. A method as claimed in claim 2, wherein forming the weft thread bundle further comprises withdrawing a number of weft threads laterally from the fabric edge and arranging the weft threads in a substantially parallel spaced relation with respect to the fabric edge between the fabric edge and the adhesive strip.

4. An apparatus for providing warp thread ends as auxiliary weft in a seam weaving device and wherein the warp thread ends extend from an edge of a length of woven fabric which is formed of the warp threads woven with transverse weft threads, the apparatus comprising:

a shedding means for successively releasing a warp thread end from the weft thread bundle by a shed change, and wherein the warp thread ends are connected to an adhesive strip prior to being so released from the weft thread bundle;

a separating means for separating the warp thread ends released by a shed change produced by the shedding means; and a cutting means for cutting the warp thread ends from the adhesive seam.

5. An apparatus as claimed in claim 4, and wherein the separating means further comprises:

thread pickers which are individually adjustable longitudinally with respect to the weft threads in the weft thread bundle; and separating wedges which are individually adjustable transversely with respect to both the weft threads of the weft thread bundle, and the warp thread ends, and which can be driven between the warp thread ends which are released by the shedding means and the warp thread ends still held in a weaving order by the weft thread bundle.

6. An apparatus as claimed in claim 5, and wherein the shedding means further comprises mutually parallel guiding tubes for the weft threads of the weft thread bundle.

7. An apparatus as claimed in claim 6, and wherein the separating means further comprises guide pieces disposed transversely with respect to the warp thread ends and between the weft thread bundle and the fabric edge, and wherein the guide pieces guide the warp thread ends.

8. A method of providing the warp thread ends of a fabric ribbon, the fabric ribbon having weft threads, warp thread ends, and a fabric edge, comprising:

providing a weft thread bundle located in spaced relation relative to the fabric edge;

withdrawing the weft threads in the vicinity of the warp thread ends a given distance away from the fabric edge, and wherein the weft threads are not withdrawn from the weft thread bundle;

forming an auxiliary shed of the remaining weft thread bundle;

aligning the warp thread ends in substantially parallel orientation, one to the others;

affixing the warp thread ends to an adhesive seam;

isolating the warp thread ends according to a given weaving order by a change of shed of the auxiliary shed;

separating the warp thread ends previously isolated by the weaving order from the warp threaded ends still held in the weaving order by the weft threads of the weft thread bundle, and wherein the respective warp thread ends are maintained at a predetermined distance apart;

cutting the warp thread ends from the adhesive seam; and withdrawing the cut warp thread ends from the auxiliary shed in the vicinity of the fabric edge.

9. An apparatus for providing the warp thread ends of a fabric ribbon as auxiliary weft in a seam weaving machine, and wherein the fabric ribbon has weft threads, warp thread ends and a fabric edge comprising:

means for positioning a weft thread bundle in spaced relation relative to the fabric edge;

means for withdrawing the weft threads in the vicinity of the warp thread ends a predetermined distance away from the fabric edge, and wherein the weft threads are not withdrawn from the weft thread bundle, and wherein weft threads have distal ends;

an adhesive seam affixed on the distal ends of the withdrawn weft threads, and wherein the adhesive seam positions the distal ends in substantially parallel relation one with the others;

shedding means for forming a shed of the weft thread bundle, and which extends substantially laterally outwardly relative to the fabric edge, and wherein the shedding means retains the warp thread ends in a predetermined weaving order, and wherein during a shed change the weaving order releases individual warp thread ends;

separating means for isolating the warp thread ends which are released by the change of shed of the shedding means, and wherein the separating means includes adjustably movable and selectively activatable thread pickers which are disposed between the weft threads and are individually movable substantially along and in the direction of the weft threads, and adjustably movable and selectively activatable separating wedges which can be selectively oriented between the warp thread ends released by the shedding means and simultaneously held in the weaving order by the weft threads; and a cutting means for cutting the warp thread ends from the adhesive seam.

10. An apparatus as claimed in claim 9, wherein the shedding means further comprises:

a plurality of guide tubes which are oriented in substantially parallel relation, one to the other, and which coact to guide the weft threads.

11. An apparatus as claimed in claim 10, wherein the respective thread pickers further comprise:

a carrier which is adjustably movable along the longitudinal dimension of the respective weft threads, and a plurality of resilient bristles which forcibly engage the weft threads, and which are borne on the carrier.

12. An apparatus as claimed in claim 11, and further comprising:

a plurality of guide pieces located adjacent the fabric edge and which extends generally transversely to and between the warp thread ends which are held in the weaving order.

* * * * *